US005899765A

United States Patent [19]

Niekrasz et al.

[11] Patent Number: 5,899,765

[45] Date of Patent: May 4, 1999

[54] DUAL BLADDER CONNECTOR

[75] Inventors: Edward J. Niekrasz, Bonita; Daniel A. Stephens, Poway, both of Calif.

[73] Assignee: Lockheed Martin Services, Inc., Cherry Hill, N.J.

[21] Appl. No.: 08/833,100

[22] Filed: Apr. 4, 1997

[51] Int. Cl.[6] ..... H01R 4/60

[52] U.S. Cl. ..... 439/201; 439/139

[58] Field of Search ..... 439/139, 143, 439/145, 199–201, 205, 271

[56] References Cited

U.S. PATENT DOCUMENTS

| | | | |
|---|---|---|---|
| 3,491,326 | 1/1970 | Pfister et al. . | |
| 3,508,188 | 4/1970 | Buck . | |
| 3,845,450 | 10/1974 | Cole et al. . | |
| 4,188,084 | 2/1980 | Buresi et al. . | |
| 4,373,767 | 2/1983 | Cairns . | |
| 4,606,603 | 8/1986 | Cairns | 350/96.21 |
| 4,666,242 | 5/1987 | Cairns | 350/96.21 |
| 4,696,540 | 9/1987 | Adams et al. | 350/96.21 |
| 4,795,359 | 1/1989 | Alcock et al. | 439/271 |
| 4,948,377 | 8/1990 | Cairns | 439/200 |
| 5,194,012 | 3/1993 | Cairns | 439/201 |
| 5,203,805 | 4/1993 | Cairns | 439/199 |
| 5,645,442 | 7/1997 | Cairns | 439/201 |
| 5,722,842 | 3/1998 | Cairns | 439/201 |

*Primary Examiner*—Steven L. Stephan
*Assistant Examiner*—Brian J. Biggi
*Attorney, Agent, or Firm*—Sidley & Austin

[57] ABSTRACT

A submersible connector having redundant bladders, each filled with a dielectric liquid. An inner bladder contains an electrical contact, and an insertion sleeve of the inner bladder is pinched closed by a spring. An outer bladder is disposed around the inner bladder, and also has an entrance sleeve that is pinched closed independently of the inner bladder. With this arrangement, the redundant bladders are constructed so as to provide independent penetrable seals.

19 Claims, 5 Drawing Sheets

DUAL BLADDER CONNECTOR

TECHNICAL FIELD OF THE INVENTION

The present invention relates in general to connectors for joining together signal lines, and more particularly to connectors adapted for mating and demating in underwater applications.

BACKGROUND OF THE INVENTION

The connector technology is well developed for coupling together electrical lines, fiber optic lines and other types of conductors that communicate different signals, including AC and DC power. There exists literally thousands of different types of connectors to fulfill the needs of numerous types of applications. Generally, connectors are constructed as two separable components, typically called a male connector and a female connector which, when joined, allow the signals and/or power to be communicated from one line to another line. As can be appreciated, long-term reliability of connectorized lines is of paramount importance.

A specialized area has developed for submersible connectors which allow the joining of lines for underwater applications. One type of underwater connector is adapted for mating and demating under dry conditions, but once mated, the joined connection can be immersed in liquids and yet maintain a reliable connection. In another type of underwater connector, the male and female connector components can be mated or demated while underwater and maintain reliable connections. The latter type of connectors are the most desirable for marine applications, in that the reliability of the connection is independent of whether the connector components are mated in wet or dry situations. Connectors that can be mated under water, known as "wetmate" connectors, generally include a pressure-compensated, dielectric liquid-filled chamber in the female half of the connector. During mating, the contact probe of the male connector passes through a penetrable entry seal of the liquid-filled chamber to connect with a female socket contact enclosed within the chamber. The penetrable entry seal maintains a seal to the male contact probe when mated, to thereby retain the compensating fluid within the chamber. The entry seal recloses when the male contact probe is removed. The penetrable entry seal tends to "wipe" the male contact probe so that the seawater, or the like, does not mix with the liquid dielectric contained within the pressure-compensated chamber. Underwater mateable connectors of such design are disclosed in U.S. Pat. Nos. 4,606,603; 4,666,242; 4,373,767; 5,194,012; 5,203,805 and 4,948,377, all by Cairns. Other types of underwater connectors are disclosed in U.S. Pat. Nos. 4,795,359 by Alcock et al.; 4,696,540 by Adams et al.; 3,845,450 by Cole et al.; 3,508,188 by Buck; and 3,491,326 by Pfister et al.

While the foregoing submersible connectors provide a reasonable degree of reliability, a need exists for yet a higher degree of reliability. For example, the connector described in U.S. Pat. No. 4,795,359 includes two or three nested, dielectric-filled bladders. The failure of the single shuttle piston is likely to allow the external liquid to enter each bladder and contaminate the dielectric, as well as the electrical contact bathed therein. In like manner, U.S. Pat. Nos. 5,203,805; 5,194,012 and 4,948,377 each describe a connector having a redundant entry seal to a dielectric-filled chamber. The entry to the connector has a plurality of interconnecting dielectric bath chambers with a wiping seal positioned between each such chamber. This type of connector essentially provides a single chamber with multiple wipers for the male electrical probe. Again, the failure of the single shuttle piston can lead to the contamination of the female electrical contact, despite the redundant entry seals.

Many of the submersible connectors that utilize a shuttle piston also employ a spring to return the piston to a rest position when demated. The spring not only increases the force necessary to mate the connector halves together, but can also cause an inadvertent demating of the connector halves.

From the foregoing, it can be seen that a need exists for a wetmate type of underwater connector that includes redundant bladders, whereby if one bladder, such as an outer bladder, becomes punctured or is otherwise rendered defective, the inner bladder can still function to maintain the female electrical contact free from contamination. Another need exists for a wetmate connector of the type where a penetrable seal associated with each of an inner and outer bladder is operable independently of each other, thereby improving the connector reliability.

SUMMARY OF THE INVENTION

According to the principles and concepts of the invention, disclosed is a connector that overcomes or substantially reduces the shortcomings and problems of the prior art connectors.

In accordance with an important feature of the invention, a wetmate type of connector includes an inner bladder and an outer bladder, each with a penetrable entry seal that operates independently of each other.

In accordance with the preferred embodiment of the invention, an insulator body is molded to an electrical conductor assembly having a socket contact. An inner bladder encloses the socket contact and is snap fit in a liquid sealed manner to the insulator body. The inner bladder is constructed of an elastomer, and includes a tubular sleeve entry seal. A hairpin type of closure spring is effective to pinch the entry sleeve of the inner bladder and thereby seal the liquid dielectric contained therein.

An outer elastomeric bladder, also having an entry sleeve, is nested over the inner bladder, and sealed by a snap-fit arrangement to the insulator body. The entry seal of the outer bladder is also pinched by a hairpin type of closure spring. A beveled entry opening to the outer bladder provides guidance of a male contact probe, first through the entry seal of the outer bladder, and then through the entry seal of the inner bladder into the socket contacts. The elastomeric entry sleeves of the outer bladder and inner bladder have openings that are smaller than the male contact probe diameter to provide a wiping action to remove any seawater or external fluid on the probe, before it enters into the redundant bladder female connector. As the male contact probe is forced into the entry sleeve of the outer bladder, the sleeve stretches and forces the closure spring apart. External fluid cannot enter and contaminate the liquid dielectric filling the outer bladder, nor can the liquid dielectric escape. As the male probe is further pushed into the female connector, the entry sleeve of the inner bladder is then forced open, as is the closure spring that attempts to pinch the entry sleeve closed. Liquid dielectric filling the inner bladder is prevented from escaping, and the dielectric liquids filling each bladder do not become mixed. Finally, the male contact probe enters the socket contacts that are contained within the inner bladder, thereby achieving a highly reliable electrical connection.

During demating of the male and female connectors, the reverse action occurs, wherein the entry sleeve of the inner bladder first closes by the pinching action of the closure spring, and then the entry sleeve of the outer bladder closes due to the closure of the associated spring, as the male probe is withdrawn from the female connector. Thus, even though the male contact probe is immersed in the external fluid when demated, the external fluid does not enter into the female connector. However, should the outer bladder become punctured, or should the external fluid enter the outer bladder and contaminate the liquid dielectric contained therein, the male electrical probe can nevertheless be reliably connected to the socket contacts that are yet protected by the inner bladder. Should the dielectric of the outer bladder become contaminated, the male probe undergoes a wiping action due to the entry sleeve of the inner bladder, and the liquid dielectric filling the inner bladder is not contaminated.

In accordance with the preferred embodiment of the invention, redundant bladders are provided for enclosing the socket contacts, and the operation of the penetrable seals of each bladder remain independent to thereby provide truly redundant, nested bladders.

BRIEF DESCRIPTION OF THE DRAWINGS

Further features and advantages will become apparent from the following and more particular description of the preferred embodiment of the invention, as illustrated in the accompanying drawings in which like reference characters generally refer to the same parts or elements throughout the views, and in which.

DETAILED DESCRIPTION OF THE INVENTION

Figure 1:
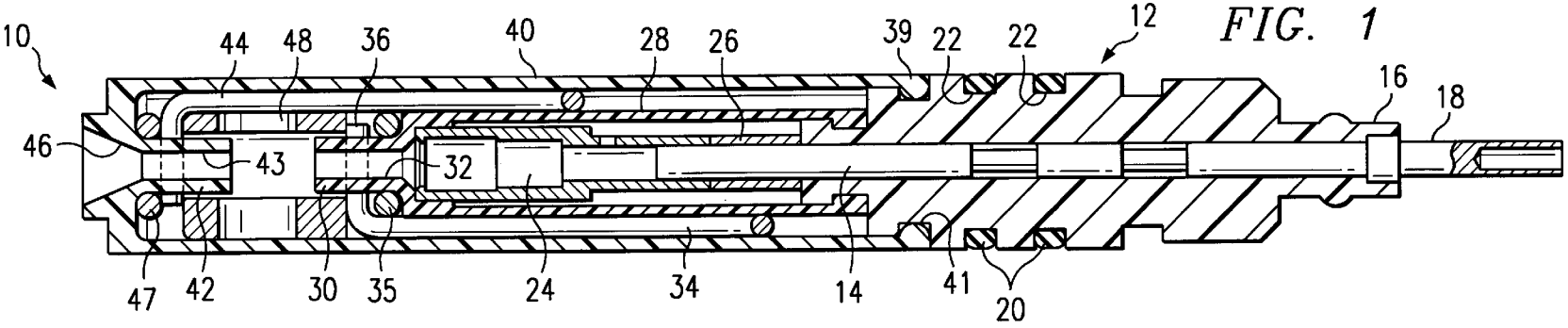
FIG. 1 is a partial cross-sectional view of an electrical contact assembly adapted for use with a female connector that is wetmateable with a male connector.

With reference now to FIG. 1, there is illustrated a partial cross-sectional view of the electrical contact assembly 10 constructed according to the preferred embodiment of the invention. As will be described more fully below, the electrical contact assembly 10 is constructed for use in a female connector housing which can be mated in underwater conditions with a male connector housing. In addition to being wetmateable, the electrical contact assembly 10 includes dual dielectric-filled bladders, each with independently operable penetrable seals to enhance the reliability of the connector.

Figure 3:
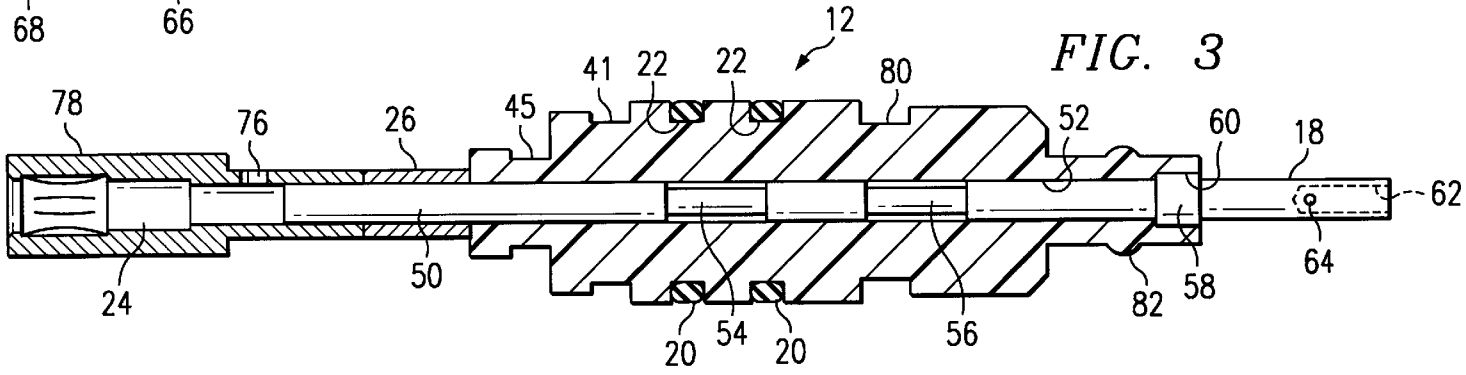
FIG. 3 is a partial cross-sectional view of an insulator body molded to the electrical conductor assembly.

An insulator body 12 is preferably constructed of a high temperature epoxy glass, polyetheretherketone, polyimide or other electrically insulating material. The insulator body 12 is bonded and sealed to a conductor assembly 14, having an elongate conductor shaft portion connected to an electrical socket contact 24. The details of the features formed integral with the insulator body 12 are shown in FIG. 3. With reference again to FIG. 1, the insulator body 12 includes a stub 16 through which an end 18 of the conductor assembly 14 extends so as to be soldered or otherwise connected to an electrical line or wire (not shown). Also, the stub 16 of the insulator body 12 is adapted for making a liquid tight seal via a boot (not shown) to an insulation covering of the electrical wire. A pair of elastomeric O-rings 20 are installed in annular grooves 22 of the insulator body 12 for sealing the electrical contact assembly 10 within a female connector housing shown in FIG. 11.

The conductor assembly 14 extends axially from the internal end of the insulator body 12. The conductor assembly 14 includes a commercially available socket contact 24 that is fixed to conductor 50 by crimping or soldering. The socket 24 is spaced from the internal end of the insulator body 12 by way of a spacer 26. The spacer 26 may be made as an internal part of the socket contact 24 or the metal conductor shaft 50.

The socket contact 24 is nested within an inner elastomeric bladder 28. The inner bladder 28 is snap fittable onto the end of the insulator body 12 by way of an annular ridge formed at the end of the inner bladder 28, and an external annular groove formed in the inner end of the insulator body 12. A dielectric fluid, such as a 10,000 centistoke (CS) silicone fluid fills the internal volume of the inner bladder 28 and thus bathes the socket contact 24 therein. The liquid dielectric functions to prevent the electrical contact surfaces of the socket contact 12 from deterioration. The inner bladder 28 includes a penetrable entry seal constructed as a tubular sleeve 30. A bore 32 of the elastomeric sleeve 30 is aligned with the socket contact 24. The elastomeric sleeve 30 is pinched closed by a hairpin type of closure spring 34. In its normal state, two orthogonal arms of the closure spring 34, one shown as reference numeral 36, pinch the elastomeric sleeve 30 closed to isolate the dielectric fluid inside the inner bladder 28 from the dielectric fluid that is contained on the outside of such bladder. As will be described in more detail below, when the end of a male contact probe is inserted into the electrical contact assembly 10, the elastomeric entry sleeve 30 stretches to provide a wiping action on the male contact. Moreover, the end of the male contact probe is effective to force the closure spring arms 36 apart to thereby allow entry of the probe into the socket contact 24, all without allowing escape of any of the dielectric fluid within the inner bladder 28.

Snap fit to the insulator body 12 is an outer bladder 40. The outer bladder 40 is constructed of an elastomeric material having a cylindrical shape. One end of the outer bladder 40 has formed thereon an internal rib 39, snap fittable into an annular groove 41 formed in the insulator body 12. As shown in FIG. 1, the outer bladder 40 fully encases the inner bladder 28. Moreover, the same type of silicone dielectric liquid fills the volume between the outer bladder 40 and the inner bladder 28. The outer bladder 40 includes a penetrable entry seal formed as an elastomeric sleeve 42. A central bore 43 within the sleeve 42 is axially aligned with the bore 32 of the inner bladder sleeve 30. Much like the inner bladder 28, the outer bladder sleeve 42 is pinched to a closed condition by a hairpin type closure spring 44, constructed similar to that of the inner bladder closure spring 34. When pinched closed, the outer bladder sleeve 42 prevents dielectric fluid from exiting the electrical contact assembly 10, and prevents external liquids, such as seawater, from entering the outer bladder 40. Formed integral with the outer bladder 40 is an entrance cone 46 for guiding a male contact probe (FIG. 12), or the like, into the electrical contact assembly 10.

A first elastomeric O-ring 35 inserted over the entry sleeve 30 of the inner bladder 28 functions to maintain the orthogonal arms 36 of the closure spring 34 axially centered on the pliable sleeve 30. Similarly, a second elastomeric O-ring is inserted over the entry sleeve 42 of the outer bladder 40 to maintain the orthogonal arms of the closure spring 44 centered on the outer bladder pliable sleeve 42. A support spacer 48, shown in detail in FIGS. 8*a*–8*c*, constructed in a general tubular form is insertable over the entry sleeves 30 and 42 to maintain the orthogonal arms of both closure springs 34 and 44 spaced apart. With this arrangement, the closure springs 34 and 44 are maintained in predefined positions to reliably squeeze the pliable portions of the tubular entry sleeves 30 and 42 completely closed. While not shown in FIG. 1, a support band maintains the closure spring 34 in close engagement with the inner bladder 28. The various structural and functional features of the electrical contact assembly 10 shown in FIG. 1 are shown and described in more detail below.

Figure 2:
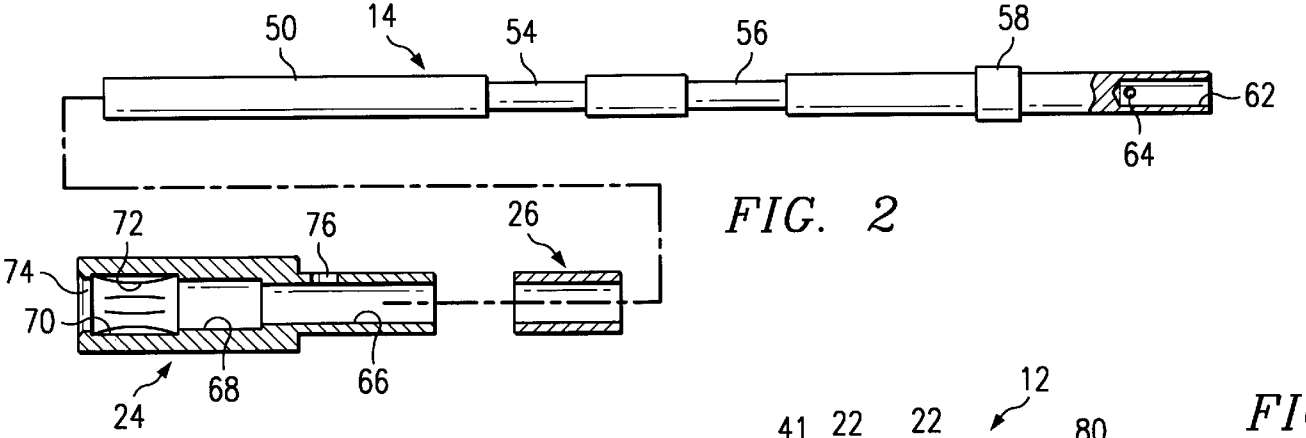
FIG. 2 illustrates a conductor assembly utilized in the electrical contact assembly of FIG. 1.

With reference to FIGS. 2 and 3, there is illustrated the components of the electrical conductor assembly 14 (FIG. 2), and the insulator body 12 molded to the conductor assembly (FIG. 3). The conductor assembly 14 includes a rigid metal shaft 50, a spacer 26 and a socket contact 24. The metal shaft 50 is machined from a copper or another highly conductive type of material. The metal shaft 50 is of a diameter that snugly fits within an internal bore 52 of the insulator body 12. A pair of annular recesses 54 and 56 allow a sealant, such as flexible epoxy, to securely fix the conductor assembly 14 within the insulator body 12. The metal shaft 50 includes an annular shoulder 58 that fits within a recessed area 60 of the insulator body 12 to prevent axial movement of the rigid conductor 14 to the left, with respect to the insulator body 12 shown in FIG. 3. The outer end of the metal conductor 50 includes an axial bore 62 for soldering therein a conductor (not shown). A transverse hole 64 is formed through the sidewall of the metal conductor 50 to facilitate soldering of a wire within the outer end thereof.

Once the conductor assembly 14 is inserted and bonded into the bore 52 of the insulator body 12, as shown in FIG. 3, a metallic spacer 26 is slid onto the metal conductor 50 and fixed thereto as shown by soldering or other techniques. With this arrangement, the annular shoulder 58 machined at one end of the metal conductor 50 and the spacer 26 fixed at the other end, prevent axial movement of the conductor assembly 14 with respect to the insulator body 12, independent of the adherent bond in the recesses 54 and 56. A gold-plated, brass socket contact 24 is then inserted onto the inner end of the metal conductor 50 and fixed thereto by solder or other techniques.

Figure 12:
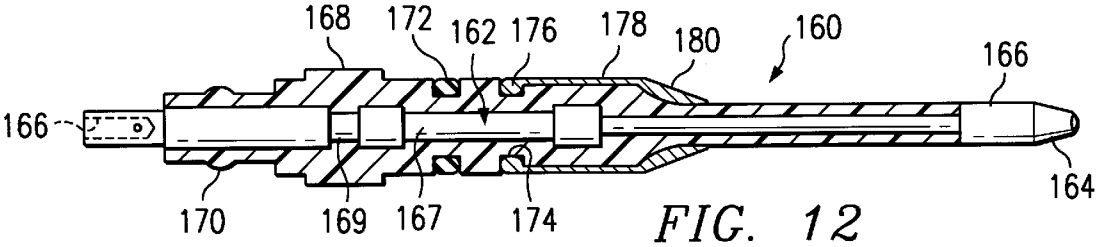
FIG. 12 is a cross-sectional view of a male contact probe.

As shown in FIG. 2, the socket contact 24 includes three stepped bores therein. A first internal bore 66 is of a diameter for fitting onto the shaft of the metal conductor 50. An intermediate bore 68 is of a larger diameter, slightly larger than the diameter of the male contact probe constructed as part of the male connector (FIG. 12). A larger diameter bore 70 is adapted for receiving a resilient contact band 72. The contact band 72 is of conventional design, having a number of spring contacts that make intimate contact with the male contact probe. The resilient contact band 72 can be readily obtained as a gold-plated beryllium copper contact band, from Amp Incorporated, part no. 8-192044-4. In the preferred form of the invention, the conductor assembly 14, the socket contact 24 and the contact band 72 can handle upwardly of 20 amps of current. Formed in the smaller diameter portion of the socket contact 24 is a fluid port 76 for allowing escape of the silicone dielectric from the internal portion of the socket contact 24, when the male contact probe is inserted therein. The port 76 thus prevents hydraulic lock of the electrically contacting parts of the male and female connector.

Lastly, the open end of the socket contact 24 includes a taper 74 to function in guiding the male contact probe into the contact band 72. The smaller diameter opening of the taper 74 is a little smaller than the larger diameter bore 70, thereby preventing the contact band 72 from being pulled out of the socket contact 24 during removal of the male contact probe.

With reference again FIG. 3, a shrinkable sleeve 78, preferably constructed of a Kynar material, is shrunk over the larger-diameter portion of the socket contact 24. The sleeve 78 functions to prevent the socket contact 24 from abrading or otherwise damaging the inside surface of the elastomeric inner bladder 28.

With reference yet to FIG. 3, the insulator body 12 includes an external annular groove 80 for fixing the electrical contact assembly 10 within the housing of a female connector half. Also, a smooth annular ridge 82 is formed on the stub of the insulator body 12 for capturing an elastomeric boot (not shown) thereto, in conjunction with the insulation covering of a wire conductor (not shown). The boot can be stretched so as to slip over and conform to the smooth annular ring 82 and provide a liquid-tight seal as well as provide a strain relief to the wire conductor. At the inner end of the insulator body 12, there is formed a first annular groove 41 for snap fitting therein the outer bladder 40. A second annular groove 45, of smaller diameter than the groove 41, is formed in the insulator body for snap fitting therein the inner bladder 28.

Figure 5:
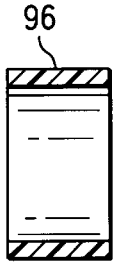
FIG. 5 is a cross-sectional view of a cylindrical support band that encircles the inner bladder.
Figure 4B:
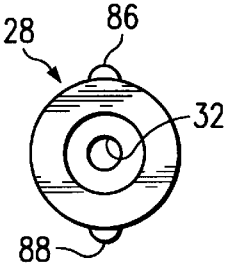
FIGS. 4*a* and 4*b* are respective cross-sectional side and end views of an inner bladder.
Figure 4A:
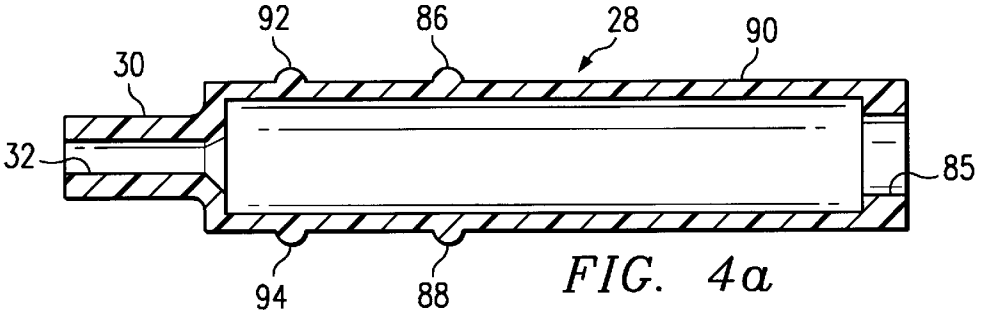

With reference now to FIGS. 4*a* and 4*b*, there is illustrated the structural features of the inner bladder 28. The inner bladder 28 is preferably constructed of a fluorosilicone material, a natural rubber, or other low durometer, high temperature rubber compatible with seawater and the silicone dielectric liquid contained therein. In practice, the inner bladder 28 is cylindrical in shape, having a sidewall thickness of about 0.030 and a outside diameter of about 0.30 inch. Also, the inner bladder 28 is a total length of about 1.67 inches. As noted above, an internal annular rib 85 functions to provide a snap fit and fluid seal of the inner bladder 28 to a corresponding annular groove 45 in the insulator body 12. A first upper and lower raised portion 86 and 88 are formed integral with the sidewall 90 of the inner bladder 28. A second upper and lower raised portion 92 and 94 are formed at locations axially spaced from the first raised portions 86 and 88. An elastomeric support band 96, shown in FIG. 5, is adapted for surrounding the sidewall 90 of the inner bladder 28, between the raised portions 86 and 92 and the raised portions 88 and 94.

Formed integral with the inner bladder sidewall 90, and opposite the inner annular rib 85 is the elastomeric entry sleeve 30. As noted above, the entry sleeve 30 functions as a penetrable entry seal to the internal volume of the inner bladder 28. The axial length of the entry sleeve 30 is of a sufficient dimension so as to allow the orthogonal arms of the closure spring 34 to reliably pinch the central bore 32 of the entry sleeve 30 completely closed. In this manner, the internal volume of the inner bladder 28 remains closed and sealed from the external volume thereof by way of the pinched entry sleeve 30. The inside diameter of the entry sleeve bore 32 is about half the outside diameter of the male contact probe. Thus, when the contact probe is forced into the bore 32 of the entry sleeve 30, the sleeve 30 is stretched tightly over the male contact probe, thereby forming a seal thereto as the probe is pushed into the inner bladder 28. Not only does the entry sleeve 30 function to form a seal to the male contact probe, but also the entry sleeve 30 functions to remove any liquid that may have accumulated on the probe surface, as it is pushed into the entry sleeve 30 of the inner bladder 28. Importantly, as the male contact probe is pushed into the entry sleeve 30 and into the socket contact 24 contained within the inner bladder 28, the bladder sidewall 90 expands to provide pressure compensation and prevent hydraulic lock.

Figure 6:
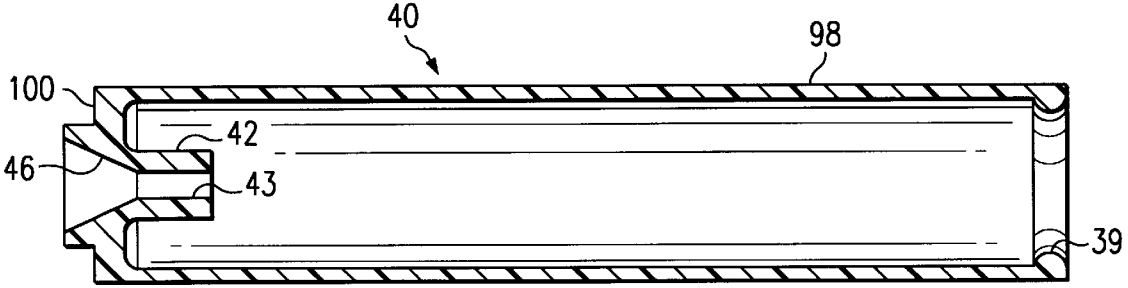
FIG. 6 is a cross-sectional side view of an outer bladder.

FIG. 6 is a cross-sectional view of the structural features of the outer bladder 40. The outer bladder 40 is formed of a similar material as that of the inner bladder 28. Moreover, the outer bladder 40 is structured to contain therein the inner bladder 20, as shown in FIG. 1. As noted above, the outer bladder 40 includes an internal annular rib 39 for snap fitting in the annular groove 41 of the insulator body 12. In contrast to the entry sleeve 30 formed axially outwardly from the inner bladder 28 (FIG. 4*a*), the entry sleeve 42 of the outer bladder 40 is formed axially inwardly thereto. Again, the bore 43 of the entry sleeve 42 is of a diameter such that the sleeve 42 is stretched when the male contact probe is forced therethrough. The entry sleeve 42 formed integral with the outer bladder sidewall 98 functions to also wipe the male probe surface free of any external fluid, such as seawater.

When pinched closed by use of the closure spring 44 (FIG. 1), the internal volume of the outer bladder 40 is sealed from any fluid external thereto. A cone-shaped entry 46 functions to provide guidance of the male contact probe into the bore 43 of the entry sleeve 42. As can be seen from FIG. 6, the thickness of the end wall 100, as well as that of the portion forming the conical entry 46, is somewhat thicker than the sidewall 98 to prevent deterioration thereof after numerous mating and demating operations with the male contact probe.

Figure 8B:
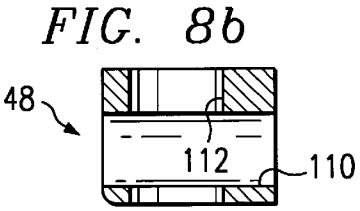
FIGS. 8*a*–8*c* are various views of a spacer support located between the inner bladder entry sleeve and the outer bladder entry sleeve to prevent collapsing of the outer bladder.
Figure 8A:
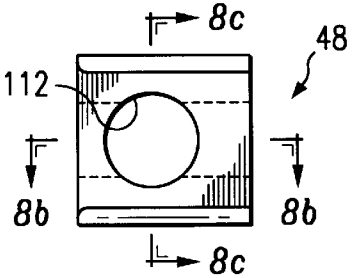
Figure 8C:
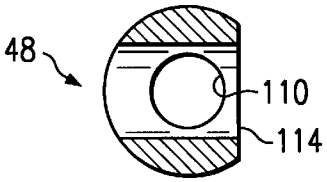
Figure 7:
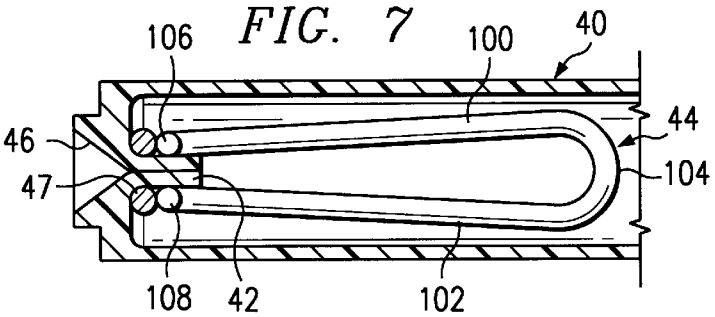
FIG. 7 is a top view of a hairpin type of closure spring for biasing the entry sleeve of the outer bladder to a closed position.

FIG. 7 is a top view of the closure spring 44 in a position pinching closed the entry sleeve 42 of the outer bladder 40. The closure spring 44 is constructed of spring-like material, such as Inconel 625. The closure spring 44 is constructed of round tubular stock of about 1/16 inch in diameter, with elongate members 100 and 102 connected together by a semi-circular piece 104. The closure spring 44 is generally U-shaped. The elongate member 100 includes a free end comprising an arm 106 bent orthogonal to the member 100. The other elongate member 102 includes a similar orthogonal arm 108. Preferably, each arm 106 and 108 is covered with an insulating sleeve (not shown) to provide a suitable and long-lasting interface with the elastomeric entry sleeve 42. The closure spring 44 is constructed so that the orthogonal arms 106 and 108 tightly engage each other when in a rest position, before assembly on the entry sleeve 42 of the outer bladder 40. When the closure spring 44 is installed on the entry sleeve 42, as shown in FIG. 7, the sidewalls of the entry sleeve 42 are tightly pinched together, thereby sealing the silicone dielectric therein. An O-ring 47 maintains the orthogonal arms of the closure spring 44 in engagement with the pliable portion of the entry sleeve 42. The closure spring 34 associated with the inner bladder 28 is similarly constructed. FIGS. 8*a*–8*c* illustrate different views of a support spacer 48. The support spacer 48 includes an internal axial bore 110 having a diameter suitable for insertion therein of the inner and outer bladder entry sleeves 30 and 42. A transverse bore 112 allows the silicone dielectric to freely pass within the outer bladder 40 into the unpinched portions of the insertion sleeves 30 and 42. As shown in FIG. 8*c*, the support spacer 48 includes a flat side surface 114 against which the elongate spring members 100 and 102 engage when the orthogonal arms 106 and 108 are forced apart by the insertion of the male contact probe into the electrical contact assembly 10. Aside from providing a flat surface against which the elongate spring members 100 and 102 can operate, the flat surface 114 also allows sufficient room between the spacer block 48 and the internal surface of the outer bladder sidewall 98, as shown more clearly in FIG. 10. The arrangement of the support spacer 48 with regard to the inner bladder closure spring 34 and the outer bladder closure spring 44 is shown in FIG. 1. The axial length of the spacer block 48 is designed to maintain the orthogonal arms of such springs spaced apart a predefined distance. Moreover, the support spacer 48 prevents partial collapse of the outer bladder 40 when an axial force is applied via the male contact probe in an attempt to penetrate the sealed insertion sleeve 42.

Figure 9:
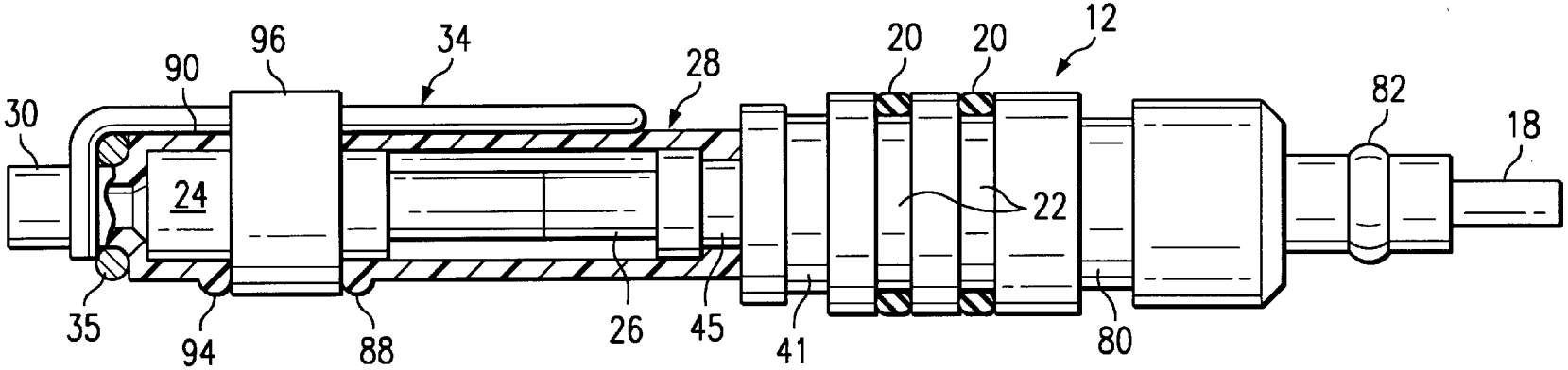
FIG. 9 is a partial cross-sectional view of the inner bladder subassembly.

FIG. 9 illustrates the inner bladder subassembly after assembly thereof. The socket contact 24 and spacer band 26 mounted to the metal conductor are fully encased within the cylindrical-shaped inner bladder 28. The elongate members of the closure spring 34 are shown disposed on the outside of the inner bladder 28, with the orthogonal arms engaged transversely across the insertion entry sleeve 30. An O-ring 35 maintains an axial space between the orthogonal arms of the closure spring 34 and the base of the insertion sleeve 30 where it joins the sidewall 90 of the inner bladder 28. The support band 96 is axially confined between the raised portions 88 and 94, for holding the elongate members of the closure spring 34 against the outer surface of the inner bladder sidewall 90. A compact assembly is thereby provided.

The inner bladder subassembly of FIG. 9 is filled with a silicone dielectric in the following manner. Prior to the installation of the closure spring 34, a vacuum source is connected to the insertion sleeve 30 to remove air from within the internal volume of the inner bladder 28. While maintaining the vacuum, a syringe or other instrument is utilized to fill the inner bladder 28 with the dielectric liquid. Then, the closure spring 34 is installed, and maintained in place by the band 96.

Figure 10:
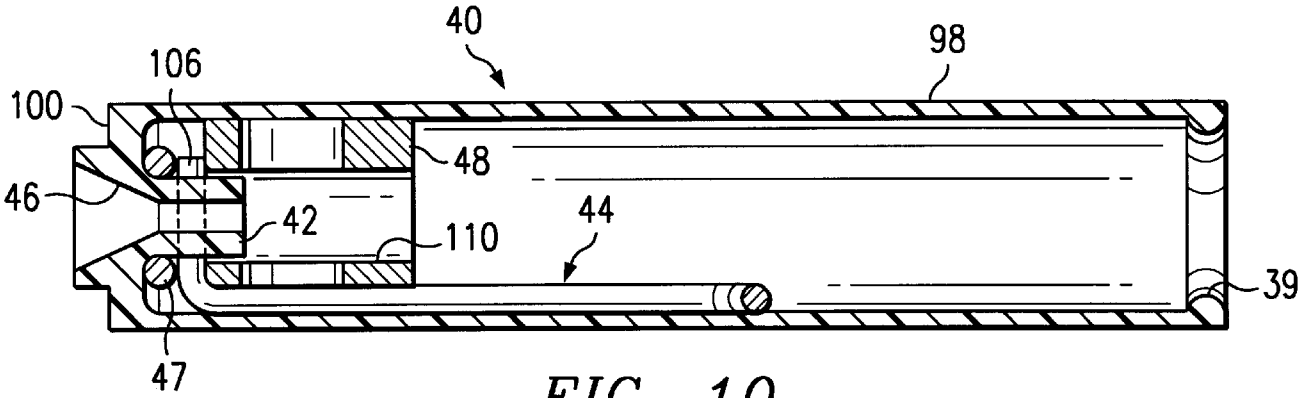
FIG. 10 is a partial cross-sectional view of the outer bladder subassembly.

The outer bladder subassembly is shown in FIG. 10. The orthogonal arm 106 of the closure spring 44 is shown captured between the end of the spacer block 48 and the O-ring 47. Once the outer bladder subassembly is assembled as shown in FIG. 10, the outer bladder 40 is held in a vertical manner, with the conical entry 46 at the bottom, and filled with a volume of de-gassed dielectric liquid from the open end of the outer bladder 40. Next, the inner bladder subassembly (FIG. 9) is inserted into the outer bladder 40 until the entry sleeve 30 of the inner bladder 28 is located within the axial bore 110 of the spacer block 48. The inner bladder subassembly is pushed into the outer bladder subassembly until the internal annular rib 39 of the outer bladder 40 snaps into the annular groove 41. When fully assembled, the electrical contact assembly 10 is generally cylindrical in shape, compact and provides an improved degree of reliability over the wetmate contacts known in the prior art.

Figure 11:
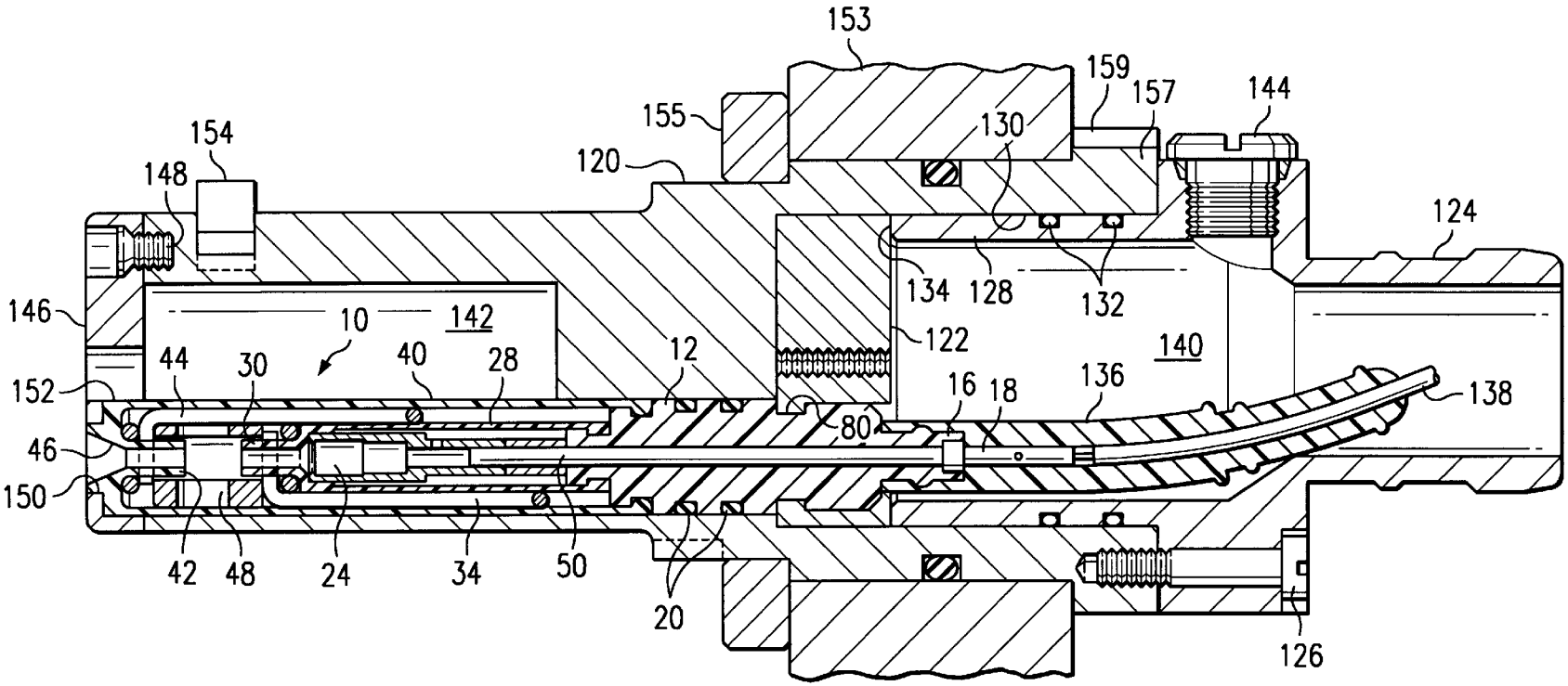
FIG. 11 illustrates the electrical contact assembly of FIG. 1 fixed within a female connector housing.

FIG. 11 illustrates the electrical contact assembly 10, as installed in a female connector half. The "female" designation relates to the type of electrical contact, not the physical configuration of the housing. The electrical contact assembly 10 is fixed within a metal housing 120 by way of a set of split retainer rings 122 that engage within the annular groove 80 of the insulator body 12. The split retainer 122 may be made in multiple parts so as to fix plural electrical contact assemblies 10 within the housing 120. A rear shell 124 is bolted or otherwise fastened to the housing 120, here shown by way of fasteners 126. The rear shell 124 includes a sleeve 128 that is sealed to an internal bore 130 of the housing 120 by way of a pair of O-rings 132. An annular edge 134 of the shell 128 is effective to clamp the split retainer 122 to the housing 120.

An insulated electrical wire-type conductor 138 is soldered to the metal conductor 18 of the electrical contact assembly 10. A flexible boot 136 is shown coupled to the stub 16 of the insulator body 12. The boot 136 provides a liquid-tight seal at one end thereof to the insulator body 12 and wire 138. The rear shell 124 includes a fitting for providing a fluid-tight coupling to a hose (not shown) that can be filled with a dielectric. The dielectric floods the chamber 140 formed within the rear shell 124. The dielectric fluid contained within volume 140 is sealed from the volume 142 of the housing 120, by way of the pair of O-rings 20 encircling the electrical contact assembly 10. A threaded plug 144 allows access to the internal volume 140 of the rear shell 124 to fill such volume with the dielectric liquid.

With reference to the female connector housing 120, there is provided an end plate 146 that is fastened to the annular edge of the housing 120 by a number of bolts, one shown as reference numeral 148. The end plate 146 includes an off-center opening 150 that serves to support the conical entry 46 of the outer bladder 44. The end plate 146 also includes a central port 152 for allowing external liquid, such as seawater, to enter the internal chamber 142. With this arrangement, any pressure developed within the electrical contact assembly 10 due to the insertion of a male contact probe, temperature, etc., allows the outer bladder 44 to expand and force external liquid contained within the volume 142 out of the female connector housing 120 by way of the purge port 152. Pressure compensation is thus afforded and hydraulic lock is prevented.

A key pin 154 is held within a recess formed in the female connector housing 120 by way of a cross pin (not shown). The key pin 154 is effective to align the female connector half with a male connector half when mating the male contact probe with the electrical contact assembly 10.

The female connector half is fastened within a stab plate 153 by the use of a large lock nut 155. The lock nut 155 is threaded onto the housing 120 to clamp the female connector half between the lock nut 155 and a shoulder 157 formed as part of the housing 120. The shoulder 157 can have a groove 159 therein for registering with a pin (not shown) secured within the stab plate 153.

With reference now to FIG. 12, there is illustrated a preferred form of a male contact probe 160. An elongate conductor 162 machined from beryllium copper, or other suitable conductive material, includes an elongate shaft with a tapered tip 164. Adjacent the tapered tip 164 is a solid cylindrical gold-plated surface 166 that makes intimate contact with the resilient contact band 72 (FIG. 2) of the socket contact 24 that forms a part of the electrical contact assembly 10 of FIG. 1. As can be appreciated, the tapered conductive end 164 facilitates the guidance of the male contact probe 160 into the electrical contact assembly 10. At the other end of the elongate conductor 162 is a bore 166 for soldering thereto a signal or power wire.

Molded around a major portion of the conductor shaft 162 is an insulator body 168. The same insulator material can be used to mold the insulator body 168 of the male contact probe 160 as is used to mold the insulator of the electrical conductor assembly 12. In molding the insulator body 168 to the conductor shaft 168, the shaft recess 167 is painted with a primer to facilitate bonding to the insulator material and providing a reliable seal therebetween. In addition, a small piece of rubber tubing is placed around the other recess 169 which functions as a seal ring when molding the insulator body 168 to the conductor shaft 162. The electrical conductor assembly of FIG. 3 can be constructed in a similar manner and vice versa. The insulator body 168 has an annular ridge 170 for allowing connection thereto of a rubber boot (not shown). The probe body 168 includes an annular channel for supporting therein an O-ring 172. A second annular groove 174 is effective to capture therein an edge 176 of a rubber seal sleeve 178. The seal sleeve 178 can be constructed of a fluorosilicone rubber or other suitable material. The seal sleeve 178 includes a conical frontal surface 180 for sealing to the conical entry 46 of the outer bladder 40. In the preferred form of the invention, the diameter of the round male contact 166 is about 0.120 inch, which is about twice the diameter of the bores 32 and 43 of the respective insertion entry sleeves 30 and 42 of the dual bladders 28 and 40. As such, the insertion sleeves 30 and 42 are effective to provide a wiping action with regard to the male probe contact 166 and provide a highly reliable seal thereto.

Figure 13:
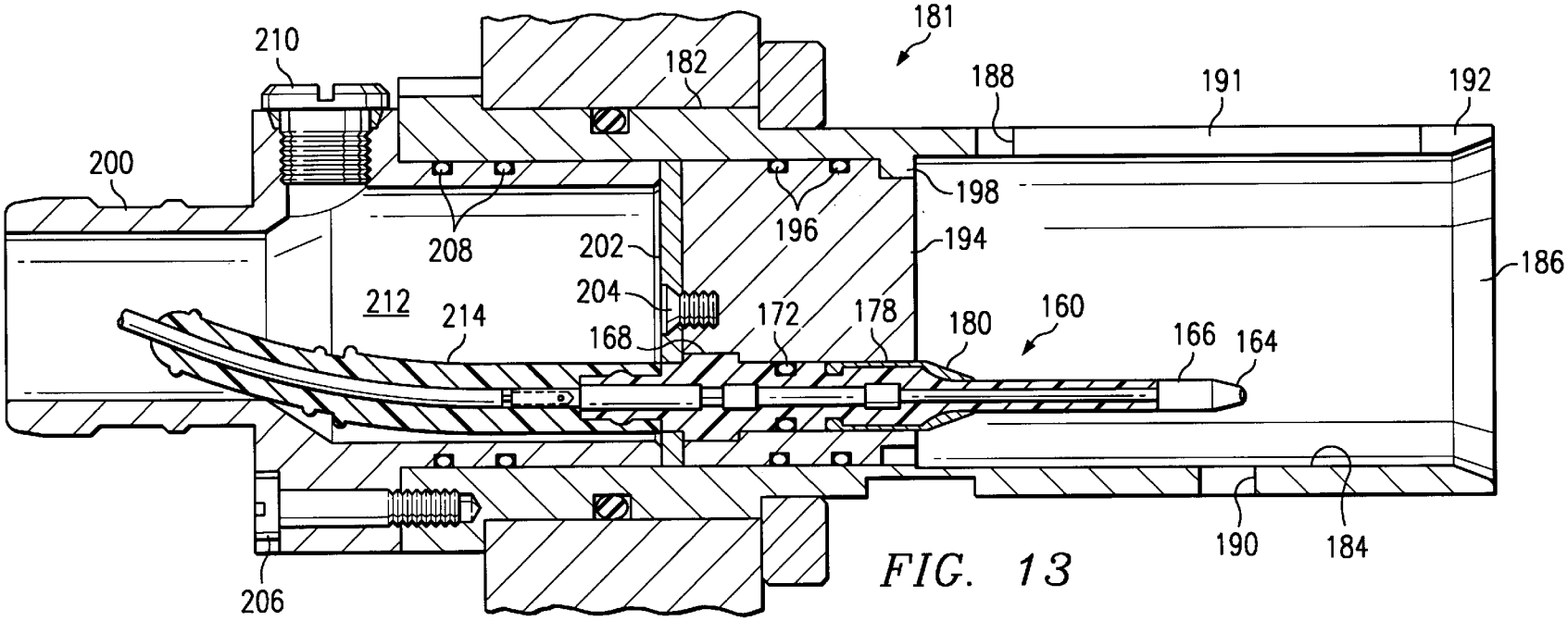
FIG. 13 is a cross-sectional view of the male contact probe of FIG. 12, mounted in a male connector housing.

FIG. 13 illustrates a cross-sectional view of a male connector half 181. The male connector half 181 includes a metal housing 182 having a frontal cylindrical receptacle 184 for receiving therein the frontal portion of the female connector half shown in the left-hand portion of FIG. 11. The male cylindrical receptacle 184 includes an internal taper 186 for facilitating the guidance therein of the frontal portion of the female connector half. The cylindrical receptacle 184 also includes a number of purge ports 188 and 190 to prevent hydraulic lock that would otherwise occur during mating and demating of the connector halves. A key slot 191 formed axially in the sidewall of the receptacle 184 receives the key pin 154 protruding from the sidewall of the female connector half. The key way slot 191 has a tapered entrance 192, again to facilitate mating of the connector halves.

The male contact probe 160 is held within a male insert holder 194. The insert holder 194 is sealed to the internal cavity of the male connector housing 182 by way of a pair of O-rings 196. The male insert holder 194 is fixed within the housing 182 by being clamped against an internal annular shoulder 198 on the frontal side thereof, and by a rear shell 200 on the back side thereof, via a retainer plate 202. Once the male contact probe 160 is inserted into the male insert holder 194, the retainer plate 202 is effective to clamp the probe 160 therein. The retainer plate 202 is fastened to the male insert holder 194 by way of a central screw 204. It should also be noted that the male insert holder 194 is angularly registered within the housing 182 by way of respective slots and ridges. In this manner, the angular position of the male contact probe 160 is fixed with respect to the key way slot 191. Hence, when the female connector half is mated with the male connector half, the male contact probe 160 is accurately aligned with the respective electrical contact assembly 10.

As noted above, a rear shell 200 is effective to clamp the male insert holder 194 within the housing 182, in a predefined position. The rear shell 200 is bolted to the housing 182 by way of bolts 206. A pair of O-rings 208 provide a seal between the rear shell 200 and the internal cavity of the housing 182. A plug 210 is threadably fastened to the rear shell 200 to allow the internal chamber 212 to be filled with a dielectric fluid.

Much like the female connector half of FIG. 11, the male connector half of FIG. 13 includes an appropriate boot 214 to provide a liquid-tight connection to the insulation cover of an electrical wire.

From the foregoing, disclosed is a wetmate type of conductor that affords a high degree of reliability. The female connector half includes an electrical contact assembly with redundant dielectric-filled bladders, each bladder having an independent penetrable seal. Thus, should the outer bladder become defective, for whatever reason, the inner bladder remains effective to protect the socket contacts contained therein free from exposure to external liquids.

While the preferred embodiment of the invention has been disclosed with reference to specific wetmate connector apparatus, and methods of manufacture and operation thereof, it is to be understood that many changes in detail may be made as a matter of engineering choices, without departing from the spirit and scope of the invention, as defined by the appended claims. Indeed, those skilled in the art may prefer to utilize the invention in connection with fiber optic conductors, rather than electrical conductors, as disclosed. The embodiment of the invention is illustrated for use with a stab connector, without a latch mechanism, that can be mounted to parallel stab plates and ganged together. As an alternative, the invention can be used with remotely operated vehicle (ROV) equipment having a bulkhead mounting and a T-shaped handle with a latch mechanism.

What is claimed is:

1. An underwater electrical connector apparatus, comprising:

an electrical contact having a body portion;

first and second bladders, each sealed to said body portion, said first bladder containing said electrical contact within a dielectric liquid, and said second bladder containing said first bladder within a dielectric liquid, said first and second bladders each having an entrance opening aligned with said electrical contact; and a first and second closure mechanism for independently closing the entrance opening of said first bladder and said second bladder.

2. The underwater electrical connector apparatus of claim 1, wherein said first and second closure mechanisms are formed independent of each other.

3. The underwater electrical connector apparatus of claim 2, wherein Said closure mechanism comprises a spring having a looped body portion with two arms formed orthogonal to said looped body portion.

4. The underwater electrical connector apparatus of claim 1, wherein the entrance opening of said first and second bladders each include a tubular elastomeric part that is pinched together by a respective said closure mechanism.

5. The underwater electrical connector apparatus of claim 1, wherein said closure mechanisms are constructed so as to be activated for opening and closing the respective said entrance openings at different times.

6. An underwater electrical socket assembly comprising:

an electrical socket having molded thereto a support body;

an inner bladder sealed to said support body for enclosing said electrical socket, a liquid dielectric filling said inner bladder and surrounding said electrical socket, said inner bladder having an entrance opening aligned with said electrical socket;

an outer bladder sealed to said support body for enclosing said inner bladder, and a dielectric liquid filling a space between said inner bladder and said outer bladder, said outer bladder having an entrance opening aligned with said electrical socket; and a spring assembly for independently closing said entrance opening of said inner and outer bladders.

7. The underwater electrical socket assembly of claim 6, wherein said spring assembly comprises a pair of hairpin type springs for pinching closed the respective bladder entrance openings.

8. The underwater electrical socket assembly of claim 7, wherein one spring is disposed inside said outer bladder for pinching an entrance opening thereof closed, and another spring is disposed outside said inner bladder for pinching an entrance opening thereof closed.

9. The underwater electrical socket assembly of claim 6, wherein said outer bladder comprises an elongate elastomeric cylinder having opposite open ends, one end being sealed to said support body and an opposite end having a tubular throat pinched together by said spring assembly.

10. The underwater electrical socket assembly of claim 6, wherein said spring assembly is disposed in the liquid dielectric contained by said outer bladder.

11. An underwater electrical socket assembly, comprising:

a socket contact;

an insulator body for supporting said socket contact;

an inner bladder sealed to said insulator body for enclosing said socket contact, said inner bladder having an entrance opening;

a liquid dielectric filling said inner bladder;

a first spring member for biasing the entrance opening of said inner bladder closed;

an outer bladder sealed to said insulator body and enclosing at least a portion of said inner bladder;

a liquid dielectric filling the outer bladder; and a second spring member for biasing an entrance opening of said outer bladder closed.

12. The underwater electrical socket assembly of claim 11, wherein said outer bladder and said inner bladder are constructed as two different bladders, providing independent flexible containers for said liquid dielectric.

13. The underwater electrical socket assembly of claim 11, wherein said outer bladder has a rib around an opening for snap fitting onto a groove formed in said insulator body.

14. The underwater electrical socket assembly of claim 13, wherein said inner bladder has a rib around an opening for snap fitting into a groove formed in said insulator body.

15. The underwater electrical socket assembly of claim 11, further including a spacer engageable with said first and second spring members for biasing apart the entrance opening of said inner bladder from the entrance opening of said outer bladder.

16. The underwater electrical socket assembly of claim 11, wherein said first spring member is constructed identical to said second spring member.

17. The underwater electrical socket assembly of claim 11, wherein said first spring member is constructed as a hairpin shape spring having a spring body with two ends, each end having an arm formed perpendicular to said spring body, said arms engaging said entrance opening of said inner bladder to pinch said entrance opening closed.

18. The underwater electrical socket assembly of claim 11, further including in combination a conductive male probe insertable through said entrance opening in said outer bladder and through said entrance opening in said inner bladder and into said socket contact.

19. The underwater electrical socket assembly of claim 18, further including in combination a male housing for supporting said underwater socket assembly therein, and a female housing for supporting said male probe therein, and wherein said male housing and said female housing have a respective key and key way to provide registration of said male probe and said electrical socket assembly.

* * * * *